US009879863B1

(12) United States Patent
Lazarov

(10) Patent No.: US 9,879,863 B1
(45) Date of Patent: Jan. 30, 2018

(54) FIRE POKER TOOL

(71) Applicant: Ross Lazarov, Prior Lake, MN (US)

(72) Inventor: Ross Lazarov, Prior Lake, MN (US)

( * ) Notice: Subject to any disclaimer, the term of this patent is extended or adjusted under 35 U.S.C. 154(b) by 0 days.

(21) Appl. No.: 15/380,106

(22) Filed: Dec. 15, 2016

(51) Int. Cl.
*F24B 15/00* (2006.01)

(52) U.S. Cl.
CPC ..... *F24B 15/002* (2013.01)

(58) Field of Classification Search
CPC ..... F24B 15/002; F24B 15/02; F24B 15/10; B25J 1/04; B65G 7/12
USPC ..... 294/9–11, 14, 17
See application file for complete search history.

(56) References Cited

U.S. PATENT DOCUMENTS

| | | | | | |
|---|---|---|---|---|---|
| 139,029 | A * | 5/1873 | Smith | B65G 7/12 | 294/15 |
| 269,767 | A | 12/1882 | Wilson | | |
| 457,219 | A | 8/1891 | Sanford | | |
| 613,303 | A * | 11/1898 | Pierce | B65G 7/12 | 294/131 |
| 883,820 | A * | 4/1908 | Menere | B65G 7/12 | 294/17 |
| 1,742,727 | A | 1/1930 | Richards | | |
| 1,953,681 | A * | 4/1934 | Johnson | F24B 15/10 | 294/103.1 |
| 2,059,439 | A * | 11/1936 | Colwill | F23J 1/04 | 294/11 |
| 2,541,863 | A * | 2/1951 | Deans | E04G 21/16 | 294/103.1 |
| 3,888,535 | A | 6/1975 | Rosso | | |
| 4,176,871 | A * | 12/1979 | Stover | F24B 15/10 | 294/10 |
| D254,704 | S * | 4/1980 | Hammond | D8/14 | |
| 4,240,657 | A | 12/1980 | Feighery | | |
| 4,477,113 | A | 10/1984 | Lybolt | | |
| 4,522,437 | A | 6/1985 | Gleman | | |
| 4,889,375 | A | 12/1989 | Leu | | |
| 5,603,543 | A | 2/1997 | Ratte | | |
| 7,131,675 | B1 | 11/2006 | Loucks | | |
| 7,344,170 | B2 | 3/2008 | Ingram | | |
| 8,162,361 | B2 | 4/2012 | Biddington | | |
| 8,226,134 | B2 | 7/2012 | O'Donnell | | |
| 8,550,437 | B2 | 10/2013 | Liou | | |
| 8,556,310 | B1 * | 10/2013 | Nabors | A47J 37/0786 | 294/26 |
| 8,661,592 | B2 | 3/2014 | Trice | | |
| 9,027,974 | B1 | 5/2015 | Considine | | |
| 9,345,912 | B2 | 5/2016 | Wells | | |
| 9,416,976 | B1 | 8/2016 | Coatis | | |
| 2005/0110289 | A1 | 5/2005 | Myers | | |
| 2010/0244474 | A1 | 9/2010 | Komely | | |
| 2014/0346794 | A1 | 11/2014 | Kronenwetter et al. | | |

FOREIGN PATENT DOCUMENTS

| | | |
|---|---|---|
| GB | 371568 A | 4/1932 |

* cited by examiner

*Primary Examiner* — Dean J Kramer
(74) *Attorney, Agent, or Firm* — Haugen Law Firm PLLP

(57) ABSTRACT

A fire poker tool that may be utilized to lift and move a log. The fire poker tool of the invention includes talons and a hook that cooperate together to engage a log in a manner that minimizes required torque and gripping forces to lift a log. The tool is particularly useful as a campfire, fire place, or fire pit tool.

8 Claims, 6 Drawing Sheets

FIRE POKER TOOL

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to tools for lifting and moving sticks, branches, logs and the like. The invention minimizes the required torque or opposing forces necessary to allow a user to grip, lift and move a log. More specifically, this invention pertains to a multipurpose tool that is particularly useful for lifting burning logs and rearranging the logs to increase optimal burning of the logs. Further, the present invention may be utilized as a camp fire or fire pit tool to poke, pull and lift fire pit logs with reduced effort than the conventional tools.

BACKGROUND

Over the years many apparatus have been devised to clamp or grip a burning log thereby allowing a user to move the log without direct contact with the embers. Typically, prior gripping and clamping tools require the use of two hands and a significant strength to apply a sufficient opposing gripping or clamping force against a log to allow a user to clamp, lift and carry the log an adequate distance. Also, although a simple shovel may be used instead to scoop under the log the shovel may also inadvertently scoop up ashes or the log may easily roll off the shovel. It is often a desire for those standing around a camp fire, fireplace or fire pit to rearrange the logs within the fire while minimizing the amount of ash disturbed and released into the air. Although pokers and tongs have been devised that may be utilized to push and pull logs, use of prior pokers and tongs typically stir up ashes and increase the amount of ash rising up in the thermal draft. Further, the tongs require a significant force from two hands to compress the tongs and apply a gripping force on the tong arms.

Additionally, although shovels and pokers have been used in the past to move burning logs, use of the shovel or poker requires an undesirable pushing motion to move the logs. Also, once the burning log is gripped with a tong or scooped with a shovel, both a lifting and balancing of the log is required. Further, the pushing and lifting may require an undesirable bending or back twisting motion by the user. There is accordingly a need for a fire pit tool that may be pulled towards the user to hook a log and then twisted to engage the log for lifting. A preferred tool may allow a user to lift and rearrange logs without significantly disturbing the remaining logs on the fire. There is a further need for a tool that is operable by the user in an up-right or standing position that also allows the user to both hook and lift a burning log.

SUMMARY

Embodiments according to aspects of the invention provide a fire pit tool that facilitates the lifting and moving of a log from a pile of burning logs. The tool includes a spaced apart hook and talon that, together, may be used ambidextrously to move and lift select logs. Once the hook is positioned under a log, the handle may be twisted to engage the talon to a top side of the log. Once the talon is engage, a tangential rotating force may be applied to a shaft of the handle to lift the log. The upward rotation of the hook and talon lifts the log upward while minimizing the disturbance of adjacent logs. Those familiar with the use of handled tools will appreciate that an upward lifting to displace a burning log is preferred over stirring motion with the tool.

In accordance with aspects of the invention, an embodiment of the invention includes a length of rod, a hook that may include a curve, a talon having opposing tips, and a handle. The angled end portion or curved hook extends outward from a lower end portion of the rod and is particularly well suited to slide under a log and hook the log when the rod is turned in either a clockwise or counter clockwise direction. An upper end of the rod includes several bends to form a handle at the upper end portion of the rod. The talon extends from the rod between the upper end and the lower end of the rod. The talon and hook are spaced apart by a distance that allows a log to be hooked and then cradled between the talon and hook. In an embodiment of the invention, a distance between an end or tip on said talon and an end or point on said hook is between 5 and 10 inches. The talon further includes a base member and opposing prongs extending from the base portion of the talon. The hook and a longitudinal axis of the rod together define a longitudinal plane. Similarly, the bent portion of the rod that forms the handle and the longitudinal axis of the rod form a plane. The plane formed by the rod and handle is substantially transverse to the longitudinal plane defined by the hook and longitudinal axis of the rod. Also, an axis of the talon extends between the opposing prongs such that the axis intersects the longitudinal plane of the hook and rod approximately tangent to the longitudinal plane.

In accordance with aspects of the invention, the base member of the talon is coplanar with the hook. The opposing prongs may together form a wedge and the prongs may curve from the base member to form opposing ends or points. Also, an end of the lower end portion of the rod may terminate in a pointed tip. Additionally, a brace may extend between bent portions of the rod that form the handle. A slot may be formed in the brace, wherein the slot may be particularly well suited as a bottle opener.

In accordance with aspects of the invention, an embodiment of the invention includes a fire pit poker apparatus including a rod, curved hook, talons and a handle. The orientation and structure of the fire pit poker may be further described in relation to a Cartesian coordinate system having x, y, and z axis and that further defines xy, yz, and xz planes. First, a length of rod extends in a y direction of the xy plane and the curved hook extends outwardly from the rod in an x direction of the xy plane. The curved hook extends from the rod proximate a lower end portion of the rod. The handle is formed from a bent portion of an upper end portion of the rod and the bent portion extends in the z direction in the yz plane. The talon is joined to the rod in spaced relation with the hook. The talon has a base member and opposing prongs extending from the base member. The base member extends from the rod between the upper end portion and lower end portion of the rod in the x direction of the xy plane, while the opposing prongs extend from the base portion in the z direction of the xz plane.

In accordance with aspects of the invention, an end of the lower end portion of the rod may terminate in a pointed tip.

Also, the opposing prongs together form a wedge and the prongs may curve from the base member to form opposing points. A brace may extend between portions of the bent rod that forms the handle. The brace may further include a slot formed in the brace.

When using the fire pit poker the user slides the tip and hook portion of the rod under and beyond a selected log. A rotation of the rod about the longitudinal axis of the rod will rotate the curved hook upward. The rod is rotated until a point of the curved hook is pointing approximately vertically upwards. The rod is then pulled so that the curved hook engages under and about a back side of the log. Once the hook is engaged, the user twists the rod so that one of the prongs of the talon engages a top side of the log. With the hook and talon engaged, the entire rod is moved upward in unison to lift the log. Those skilled in the art will appreciate that this hook, twist and lifting motion may all be accomplished with a single hand.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
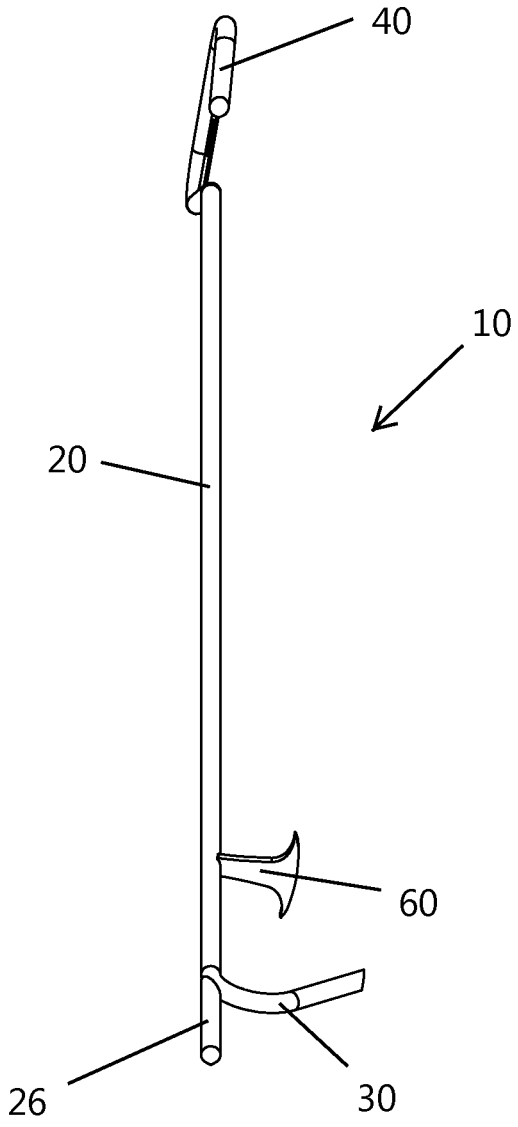
FIG. 1 is a front perspective view of a fire pit poker tool in accordance with an embodiment of the invention.
Figure 2:
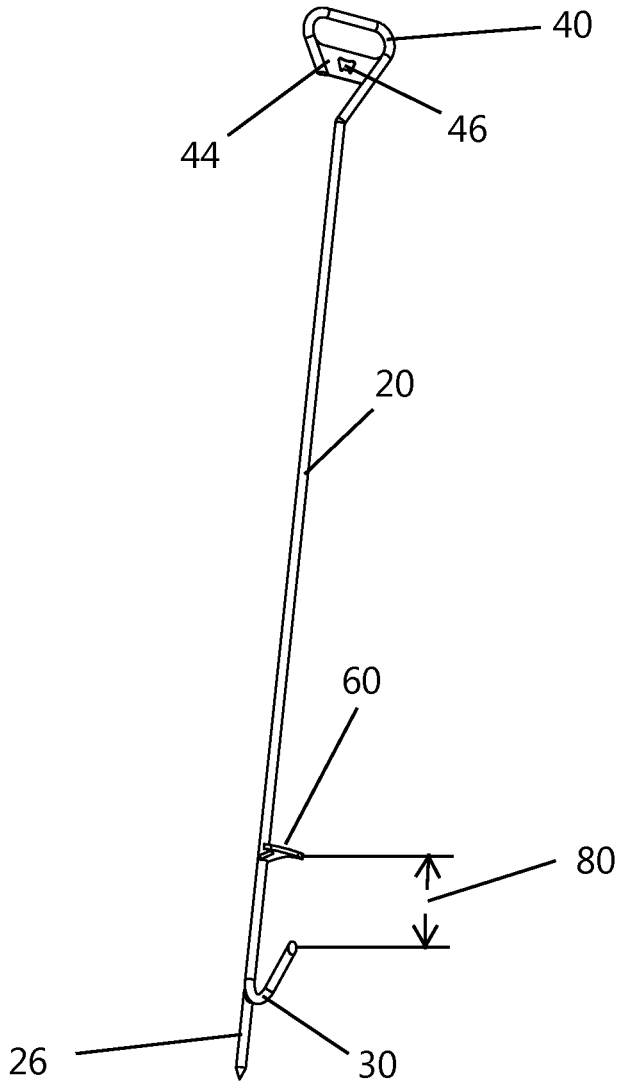
FIG. 2 is a right side perspective view of the fire pit poker tool of the type shown in FIG. 1.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The fire pit poker tool 10 of the present invention generally includes a rod 20, hook 30, handle 40, and talon 60. The rod 20 includes a lower end portion 22 and upper end portion 24. The handle 40 is formed by bent portions of the upper end portion of the rod 20. The hook 30, talon 60 and handle 40 may be used in cooperation together to engage, lift, and carry a log. The rod 20, hook 30 and talon 60 may be constructed from steel, aluminum, iron, a high strength alloy or other metal composite that is light weight, durable, resists bending and has a high tensile strength. The length of the rod 20 may range between 36-64 inches, the diameter of the rod may range between ¼-⅝ inch, the radius of the curved hook 30 may range between ½ and 4 inches, the straight portion of the hook 30 may extend at an approximately 45 degree angle from the lengthwise axis of the rod wherein a tip of the hook may be separated from the rod by a distance between 2-6 inches, the talon width may range between 1-3 inches and the talon length may range between 1-4 inches, and the distance between the talon and hook may range between 5-10 inches. Those skilled in the art will appreciate that other materials and dimension may be incorporated without departing from the scope of the invention.

Figure 3:
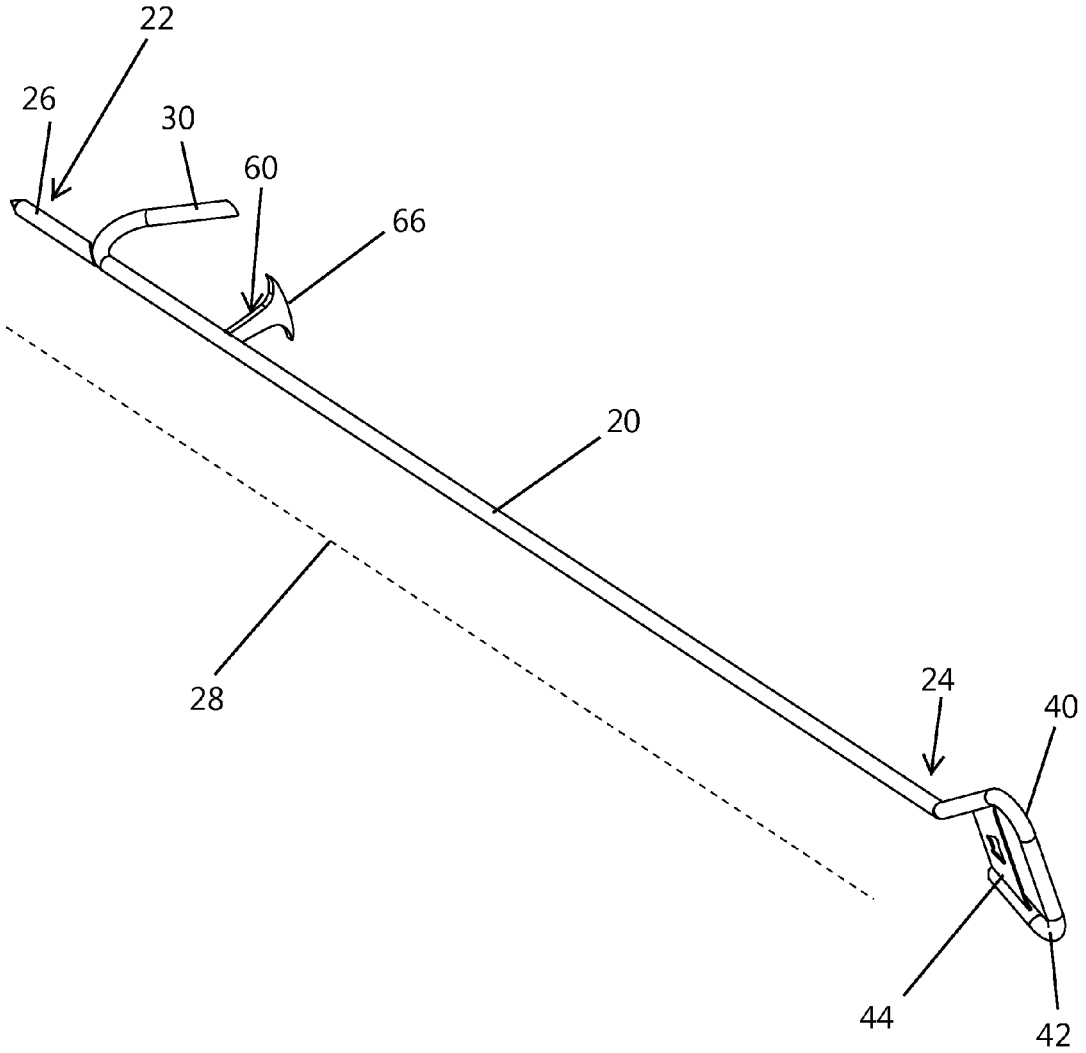
FIG. 3 is a left back perspective view of the fire pit poker tool in accordance with an embodiment of the invention.
Figure 4:
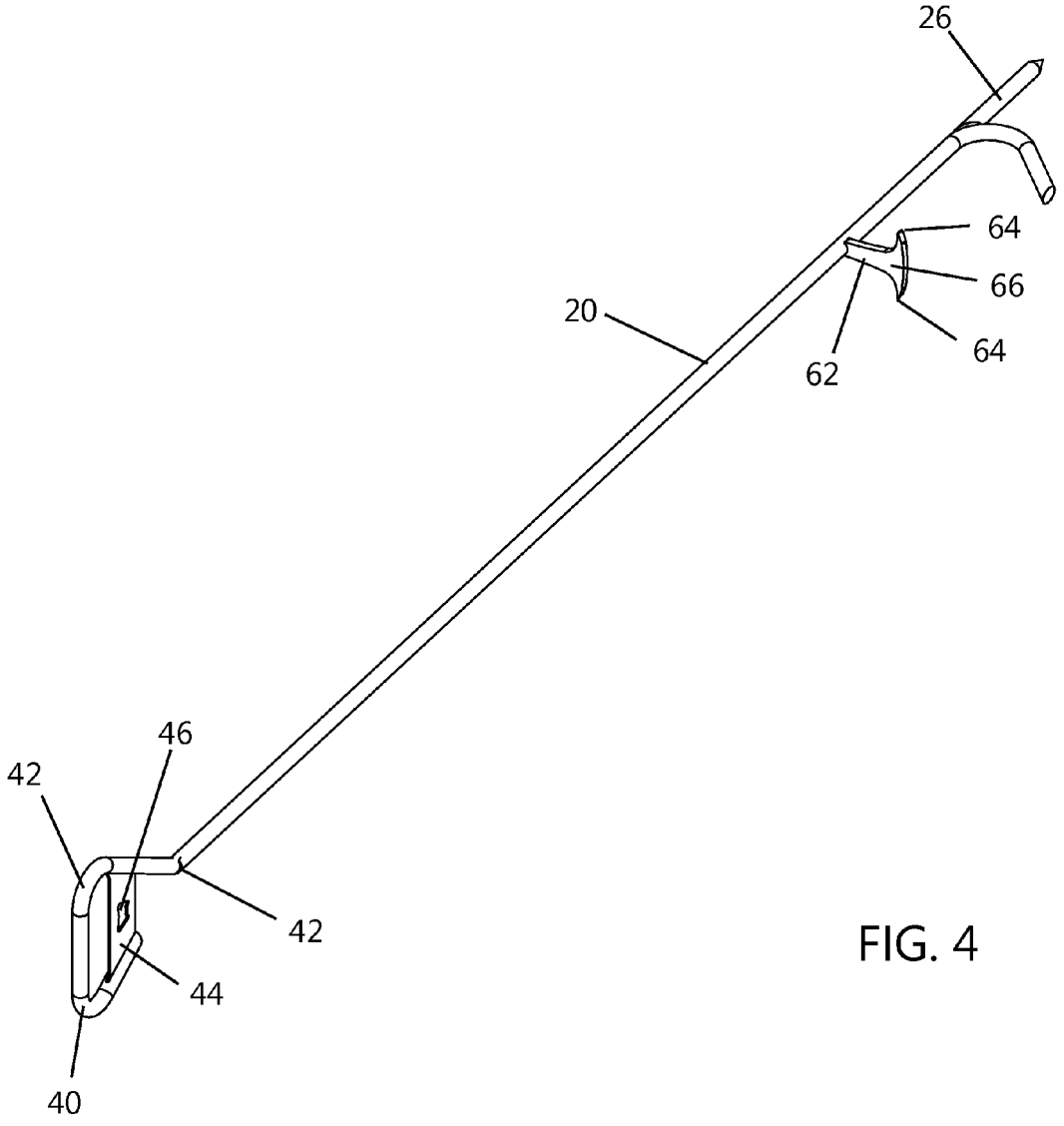
FIG. 4 is a right back perspective view of the fire pit poker tool in accordance with an embodiment of the invention.

With reference to the Figures, the fire pit poker tool 10 is described in greater detail. FIGS. 1-4 illustrates embodiments of the fire pit tool 10 having a rod 20 having lower end portion 22 and upper end portion 24. The lower end portion 22 of the rod 20 terminates in pointed tip 26. Curved hook 30 extends outwardly from the rod 20 at the lower end portion 22 of the rod and proximate to the tip 26 of the rod. The curved hook 30 includes a curved portion 32 having a defined radius and a straight portion 34. The straight portion terminates in a point 36. The upper end portion 24 of the rod 22 includes several bends or bent portions in the rod 20 that together forms the handle 40. Brace 44 extends between bent portions 42 of the handle. The brace 44 may include a slot 46 that is sized and shaped to be particularly useful to pry a bottle cap off a bottle. Talon 60 extends outwardly from the rod 20 near the lower end portion 22 and is spaced apart from the hook 30. Talon 60 includes base member 62 and prongs 64. The opposing prongs 64 together form a wedge 66 and each prong is curved and terminates at point 70. Those skilled in the art will appreciate that although curved and pointed prongs may provide an efficient engaging structure, a prong of sufficient height and width may have a variety of shapes capable of being used to perform a grappling function. Segment 28, illustrated in FIG. 3, is shown extending lengthwise parallel to the longitudinal axis of the rod. Hook 30 and talon 60 are spaced apart by a distance represented by arrows 80 in FIG. 2. The separation distance 80 between the hook 30 and talon 60 may be varied depending upon the size of the logs to be picked and placed. Further, although the hook 30 is described as having a curve, those skilled in the art will appreciate that the hook 30 extending from the rod 20 may include other configurations that still function as a hook.

Figure 5:
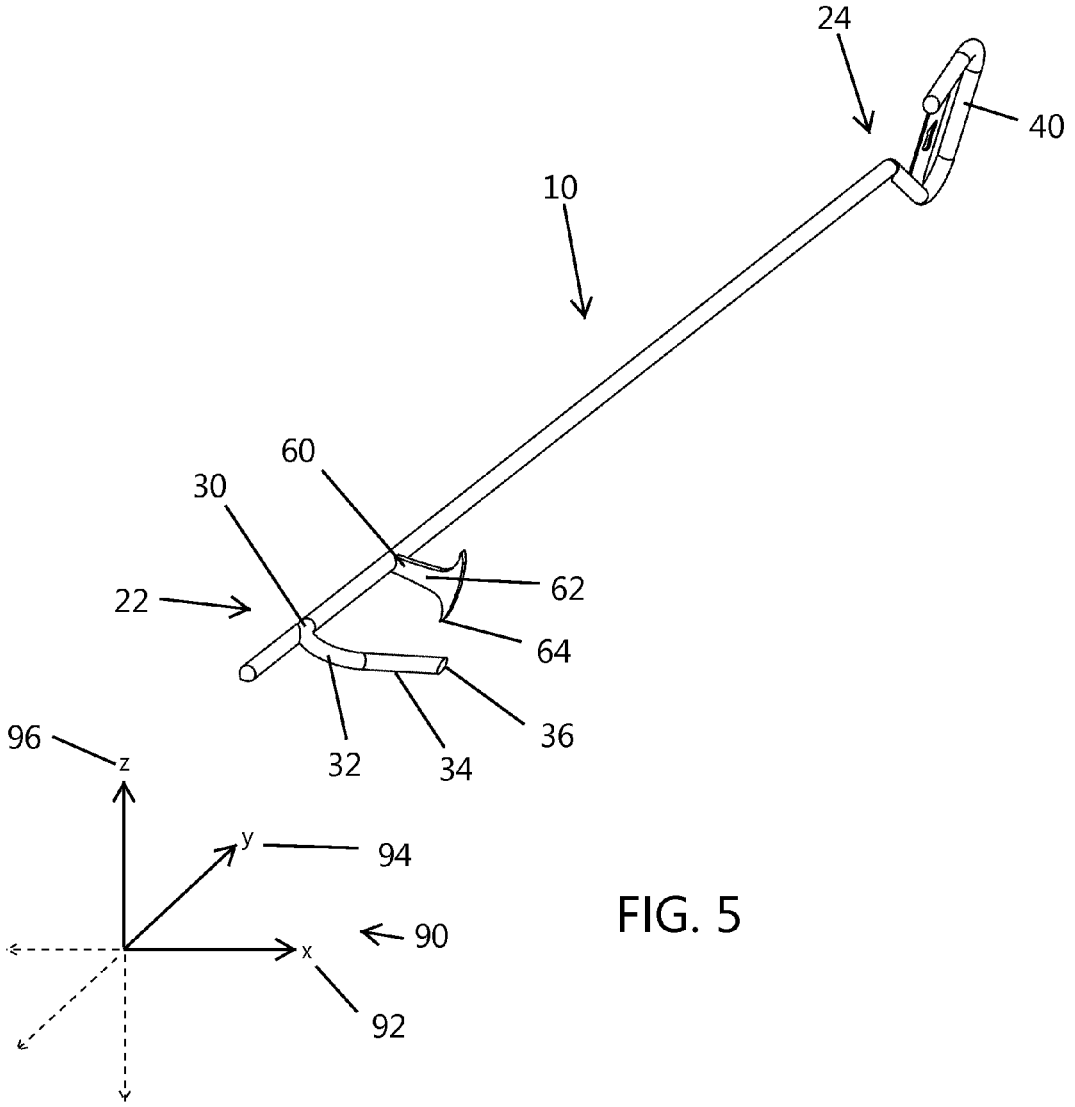
FIG. 5 is a front right perspective view of the fire pit poker tool in accordance with an embodiment of the invention.
Figure 6:
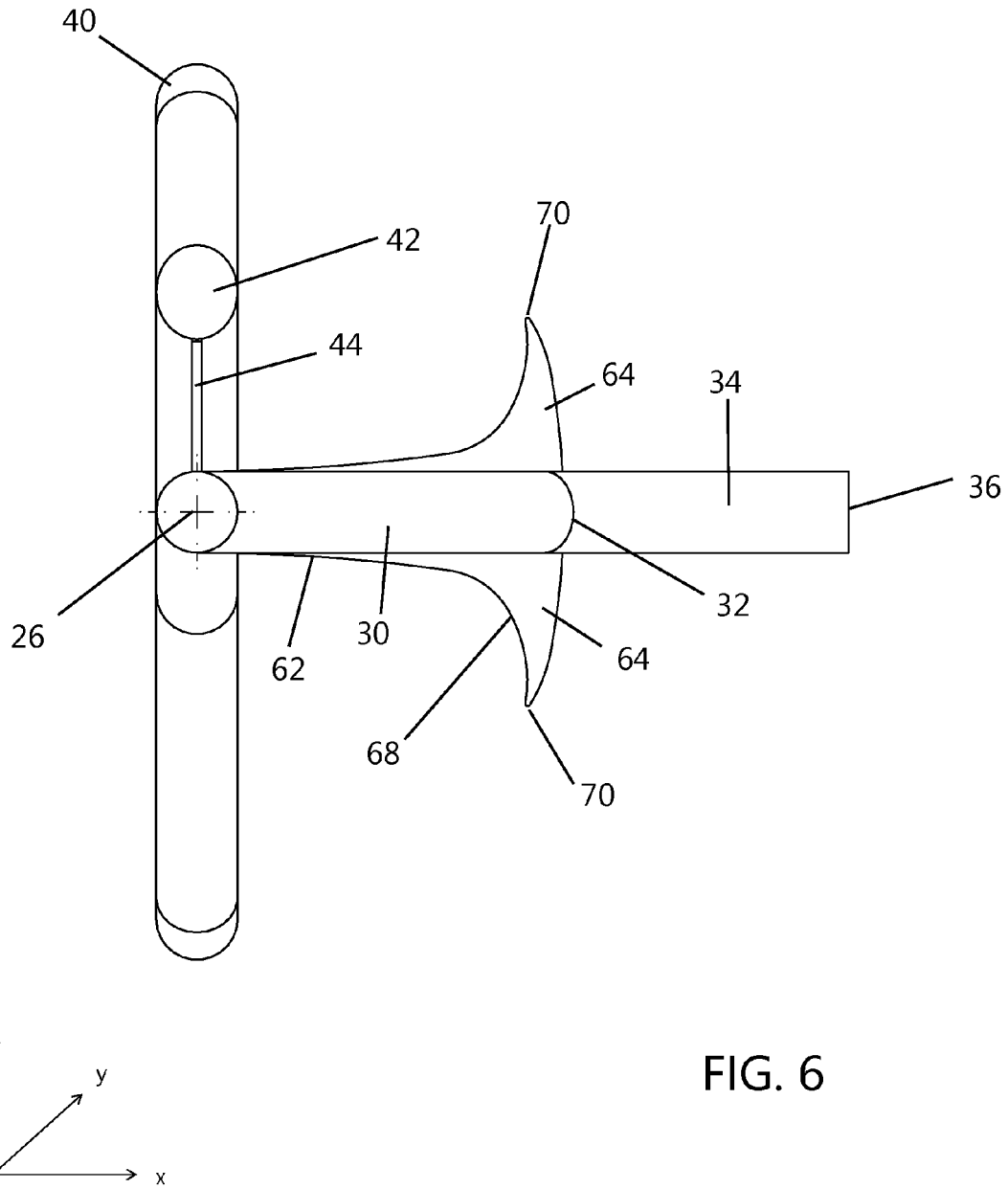
FIG. 6 is a front view of the fire pit poker tool in accordance with an embodiment of the invention.

With reference to FIGS. 5 and 6, those skilled in the art will appreciate that the relative orientation of the component parts of the fire pit poker 10 may be described with reference to a Cartesian coordinate system 90. Rod 20 extends generally in the y direction (y axis) 94 through the xy plane or longitudinal plane. Hook 30 extends generally in an x direction 92 through the xy plane, wherein the hook may be described as extending generally perpendicular to the rod or y axis 94. Similarly, talon 60 extends outward from the rod in the x direction 92 through the xy plane. An axis may be defined extending between prongs 64 of talon 60. The axis of the talon extending between the prongs 64 in the z direction along the xz plane and intersects the longitudinal or xy plane. The axis of the talon may further intersect the xy plane approximately transverse to the xy plane. Handle 40 is bent towards and away from the longitudinal axis of the rod in the yz plane, wherein the bent portions and the longitudinal axis together define a plane that is substantially transverse to the longitudinal plane defined by the hook and the longitudinal axis of the rod (in the xy plane).

In use, it may be desirable to move a burning log in a fire pit. The fire pit poker 10 may be used to move and lift logs while remaining a comfortable distance from the fire pit embers. The user slides the tip 26 of the rod 20 and the hook 30 under and beyond a selected log. Once the hook extends past a back or front side of the log, the rod 20 is rotated about the longitudinal axis of the rod 20 to thereby rotate the curved hook 30 upward. The rod 20 is rotated until a point 36 of the curved hook 30 is pointing upward in the z direction which may be approximately vertically upwards. The rod 20 is then pulled so that the curved hook 30 engages under and about the back or front side of the log. Once the hook is engaged, the user applies a force to one side of the handle 40 and twists the rod 20 to one side or the other of the log. In this manner one of the prongs 64 of the talon 60 engages a top or bottom side of the log corresponding with a tangent front or back of the log. Those skilled in the art will appreciate that the opposing prongs allow an ambidextrous user a choice how the log is to be rotated and lifted. With the hook 30 and talon 60 engaged, the entire fire pit poker 10 is moved upward to lift the log. The hook, twist and lifting motion may all be accomplished while using either the left or right hand to grasp handle 40.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A fire pit poker apparatus, said apparatus comprising:

a length of rod;

a hook extending from a lower end portion of said rod, wherein the hook and a longitudinal axis of said rod together define a longitudinal first plane of said apparatus;

a handle formed from a bent portion of an upper end portion of said rod, wherein said bent portion and said longitudinal axis of said rod define a second plane that is substantially transverse to said longitudinal first plane defined by said hook and said longitudinal axis of said rod;

a talon extending from said rod between said upper end and said lower end of said rod, wherein said talon includes a base member and opposing prongs extending from the base member of said talon; and an axis of said talon extends through said base member and said opposing prongs, wherein said axis of said talon intersects said longitudinal first plane approximately transverse to said longitudinal first plane, and further wherein the axis of said talon is aligned approximately parallel with the second plane, and further wherein a lengthwise axis of said base member intersects said second plane approximately transverse to said second plane.

2. The apparatus as recited in claim 1, wherein the base member of said talon is coplanar with said hook.

3. The apparatus as recited in claim 1, wherein an end of said lower end portion of said rod terminates in a tip.

4. The apparatus as recited in claim 1, wherein the opposing prongs and base member together form a wedge.

5. The apparatus as recited in claim 4, wherein said prongs curve from said base member to form opposing points.

6. The apparatus as recited in claim 1, further including a brace extending between the bent portion forming the handle.

7. The apparatus as recited in claim 6, further including a slot formed in the brace.

8. The apparatus as recited in claim 1, wherein a distance between a point on said talon and a point on said hook is between 5 and 10 inches.

* * * * *